US007422355B2

(12) United States Patent
Hirata

(10) Patent No.: US 7,422,355 B2
(45) Date of Patent: Sep. 9, 2008

(54) ILLUMINATION DEVICE

(75) Inventor: Toshimi Hirata, Ehime (JP)

(73) Assignee: Youth Engineering Co., Ltd, Ehime (JP)

( * ) Notice: Subject to any disclaimer, the term of this patent is extended or adjusted under 35 U.S.C. 154(b) by 0 days.

(21) Appl. No.: 10/574,409

(22) PCT Filed: Sep. 30, 2004

(86) PCT No.: PCT/JP2004/014372

§ 371 (c)(1),
(2), (4) Date: Dec. 4, 2006

(87) PCT Pub. No.: WO2005/031208

PCT Pub. Date: Apr. 7, 2005

(65) Prior Publication Data

US 2007/0177393 A1 Aug. 2, 2007

(30) Foreign Application Priority Data

Sep. 30, 2004 (JP) ..... 2003-342104

(51) Int. Cl.
*F21V 7/04* (2006.01)

(52) U.S. Cl. ..... 362/565; 362/161; 362/237; 362/246

(58) Field of Classification Search ..... 362/800, 362/555, 565, 157, 171, 161, 174, 227, 231, 362/235, 237, 246, 447, 448; 340/815.45, 340/815.5, 815.55, 815.56, 815.65
See application file for complete search history.

(56) References Cited

U.S. PATENT DOCUMENTS 3,435,286 A 3/1969 Kayatt ..... 315/47
3,882,353 A 5/1975 Ackley ..... 315/68
4,417,182 A 11/1983 Weber ..... 315/210
4,492,896 A 1/1985 Jullien ..... 315/153
5,852,514 A * 12/1998 Toshima et al. ..... 359/599
6,241,362 B1 * 6/2001 Morrison ..... 362/231
6,550,936 B2 * 4/2003 Foley ..... 362/268
6,575,613 B2 * 6/2003 Brown et al. ..... 362/565
6,726,350 B1 * 4/2004 Herold ..... 362/555
7,275,839 B2 * 10/2007 Coushaine et al. ..... 362/231
2004/0179355 A1 * 9/2004 Gabor ..... 362/161

* cited by examiner

*Primary Examiner*—Jong-Suk (James) Lee
*Assistant Examiner*—Julie A. Shallenberger
(74) *Attorney, Agent, or Firm*—Haverstock & Owens LLP

(57) ABSTRACT

An illumination device is provided which includes a lighting stand (3) in which a torch portion (11) including a light source support (13) on which a plurality of light sources (2*a* to 2*c*) is supported is provided upright on a base in which a control circuit unit (22) to change the light emission from each of the light sources 2*a* to 2*c*, a light scattering member (4) formed by molding a semitransparent resin to have a cap-like shape nearly like a candle frame, fitted on the light source support (13) and which scatters the illumination light emitted from the light sources (2*a* to 2*c*), to be bright itself, a shade member (5) formed from a transparent resin and attached over the outer surface of the lighting stand (3), and a shielding/diffusing member (6) assembled, being rounded like a cylinder, inside the shade member (5) to diffuse the illumination light emitted from the light sources (2*a* to 2*c*). Thus, the illumination light emitted from the light sources can be projected on the shade member (5) to create flaring illumination light like a candle frame.

7 Claims, 6 Drawing Sheets

ILLUMINATION DEVICE

TECHNICAL FIELD

The present invention relates to an illumination device including a plurality of light sources each being an incandescent lamp and adapted to present light from the light sources as flaring illumination light which looks like a candle frame.

This application claims the priority of the Japanese Patent Application No. 2003-342104 filed in the Japanese Patent Office on Sep. 30, 2003, the entirety of which is incorporated by reference herein.

BACKGROUND ART

The illumination device such as a candlestick functions to simply lighten a living space or the like as well as to create a healing or comforting atmosphere by indirect or controlled lighting. For example, the Japanese Patent Application Laid Open No. 106890 of 1997 (will be referred to as "Patent Document 1" hereunder) discloses an illumination device that includes a plurality of light sources disposed in different positions of one support and a controller that controls the light emission from the light sources to change the light emission as the time elapses. In this illumination device, the light-emitting position and amount of light emission are gradually changed as the time elapses to create a unique atmosphere with flaring illumination light looking like a candle frame. Also, the Applicant of the present invention proposed, in the Japanese Patent No. 2968483 of (will be referred to as "Patent Document 2" hereunder), an illumination device that provides flaring illumination light as above.

In the Japanese Patent Application Laid Open No. 115003 of 1989 (will be referred to as "Patent Document 3" hereunder), there is disclosed an illumination device that includes a base portion, generally cup-shaped light scattering filter installed to the base portion to surround a plurality of light emitters which emit light of different color tones and scatter the emitted light, and a generally spherical shade assembled to the base portion to enclose the light emitters and light scattering filter. In this illumination device, the light from each light emitter is scattered by the light scattering filter for each of the light emitters not to cast a shadow on the shade. Each of the light emitters is phase-controlled by a light-emission amount controlling circuit also included in the illumination device to flicker so that the shade will be varied in color and other respects as the time elapses.

Note here that the illumination device disclosed in the Patent Document 1 provides flaring illumination light like a candle frame. However, the Patent Document 1 teaches nothing about any construction for preventing the internal parts such as the light sources, for example, from being directly visible from outside when the illumination device is in use. The Patent Document 1 teaches only an idea of simulating a candle frame only with the flaring illumination light, but not how to approximate the flaring illumination light more to the candle flame.

In the illumination device disclosed in the Patent Document 3, the light from each light emitter is scattered in the entire space inside the shade by the light scattering filter so that the illumination is provided while being changed in amount of light emission and color by the shade as the time elapses. Therefore, this illumination device has no function to approximate the illumination light to a candle frame which will create a healing or comforting atmosphere as in the Patent Documents 1 and 3. The illumination device disclosed in the Patent Document 3 is not advantageous in that it needs the multiple light emitters that emit light of different color tones and are not easy to commercially obtain.

The illumination device disclosed in the Patent Document 2 is constructed like the illumination device disclosed in the Patent Document 3 in which there are provided the light sources disclosed in the Patent Document 1. In the illumination device proposed in the Patent Document 2, each of the light sources will not cast a shadow on the shape and the light sources are controlled in light emission individually to flare the illumination, but the globe is formed nearly spherical. Thus, in this illumination device, the receptacle and globe are not near each other. The light will scattered between the receptacle and globe. The candle flame is long, but the illumination light on the globe surface will look as a generally circular image and the flaring of the candle frame-like illumination light be smaller. Also the illumination device as a whole is integrally constructed. Thus, for illumination light with different color tones corresponding to places and atmospheres where the illumination device is used, the globe and light sources have to be replaced, which will be very troublesome.

DISCLOSURE OF THE INVENTION

It is therefore desirable to provide an illumination device capable of projecting, onto the surface of a shade member, illumination light more approximate in shape to a candle frame, that is, an elongated illumination light.

It is also desirable to provide an illumination device capable of increasing, when projecting illumination light in a shape like a candle frame onto the surface of a shade member, the flaring of the illumination light like a candle frame.

According to the present invention, there is provided an illumination device including a plurality of light sources changed in light emission individually by a control circuit, a lighting stand including a torch portion and base portion, light scattering member, shade member and shielding/diffusing member. In the lighting stand, the torch portion has installed integrally thereto a light source support to support each of the light sources at a predetermined height removably, and the base portion supports the torch portion in upright position. The light scattering member is formed from a cap-shaped member removably fitted to the light source support to scatter illumination light emitted from each light source. The shade member is shaped in the form of a transparent or semitransparent cylinder having a longer axis and larger diameter than the lighting stand, and installed to surround the lighting stand. The shade member has the outer surface thereof formed linearly in the axial direction, for example, to refract vertical light for vertical diffusion and thus for easy appearance of vertical flaring. The shielding/diffusing member is removably installed inside the shade member to shield the lighting stand while further diffusing the illumination light emitted from each light source and diffused by the light scattering member so that the illumination light will go out of the outer surface of the shade member. Having elasticity for radial spread-out from a rolled-up state, the shielding/diffusing member is in close contact with the inner surface of the shade member.

Of the illumination device constructed as above according to the present invention, the lighting stand is placed on a table or the like, and the shade member is installed to surround the lighting stand. The shielding/diffusing member provided inside the shade member shields the lighting stand to prevent the latter from being visible from outside. When the illumination device is turned on, each of the light sources installed to the light source support above the torch portion having a predetermined height will emit light varying in light emission under control of the control circuit. The light scattering member installed to the light source support to enclose the light sources scatters the illumination light emitted from the light sources in the internal space of the shade member. Further, in the illumination device, the illumination light is allowed to go out of the outer surface of the shade member through the shielding/diffusing member so that the shade member will be brighter about a portion thereof opposite to each of the light sources. In the illumination device, as each of the light sources is controlled to gradually change in light emission, the brightness is changed while illuminated portion is moved horizontally and vertically on the outer surface of the shade member to approximate the illumination light to a candle frame.

In the illumination device according to the present invention, since the shade member is formed cylindrical and the distance between the light scattering member and shade member is shorter than in the conventional illumination device, the light scattered by the light scattering member and projected on the shade member having the shielding/diffusing member provided on the inner surface thereof will easily appear to flare on the outer surface of the shade member. Especially, a shade member whose outer surface is axially straight will create remarkable vertical flaring of the illumination light, more approximate to a candle frame.

These objects and other objects, features and advantages of the present invention will become more apparent from the following detailed description of the best mode for carrying out the present invention when taken in conjunction with the accompanying drawings.

BRIEF DESCRIPTION OF THE DRAWINGS

FIG. 6 explains an illumination device as a second embodiment of the present invention, in which

BEST MODE FOR CARRYING OUT THE INVENTION

Figure 1:
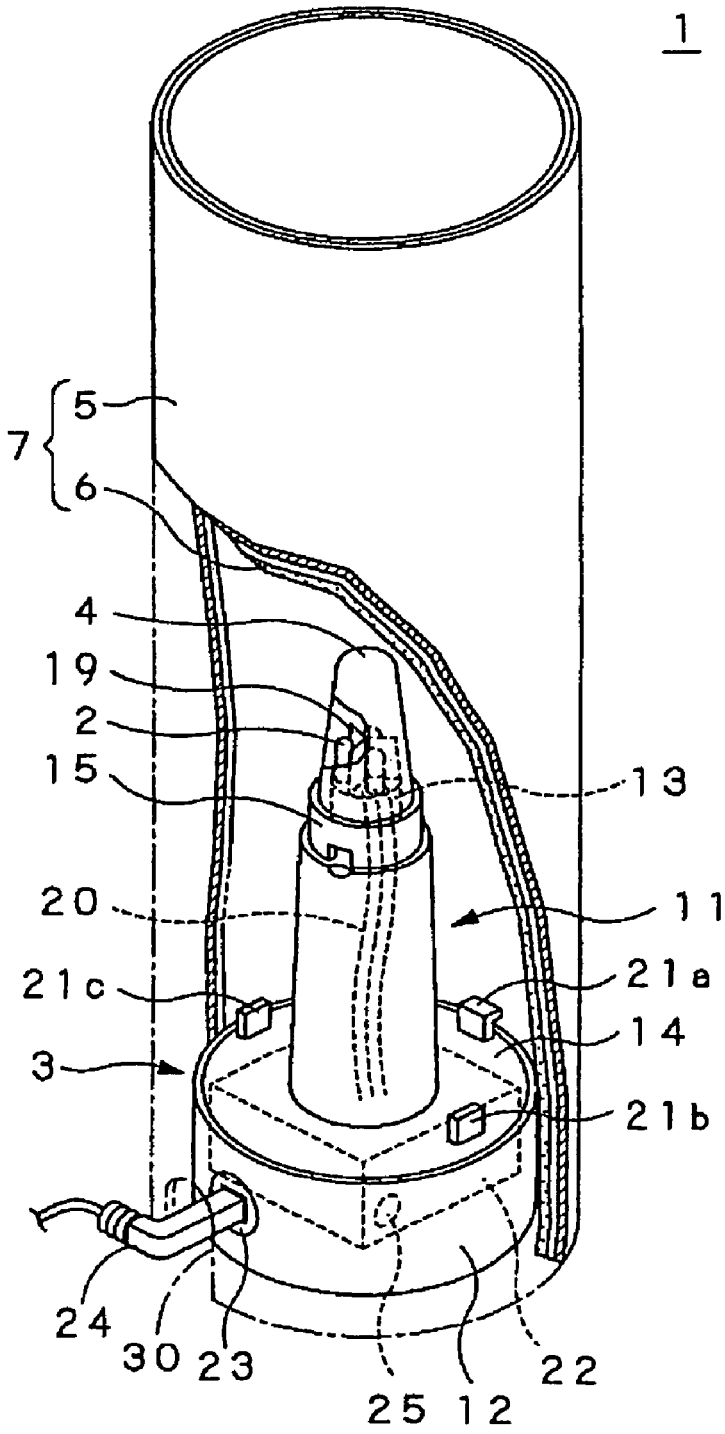
FIG. 1 is a partially fragmentary perspective view of an illumination device as an embodiment of the present invention.

The present invention will be described in detail below concerning the embodiments of the present invention with reference to the accompanying drawings. FIG. 1 shows an illumination device, generally indicated with a reference numeral 1, as the first embodiment of the present invention.

The illumination device 1 is to be used on a table or the like in a relatively gloomy living room or restaurant. The illumination device 1 will create a healing or comforting atmosphere by providing an elongated, flaring illumination like a familiar candle flame.

As shown in FIG. 1, the illumination device as the embodiment of the present invention includes three light sources 2*a* to 2*c*, lighting stand 3 having the light sources 2*a* to 2*c* fixed thereto, light scattering member 4 to scatter light emitted from the light sources 2*a* to 2*c* fixed to the lighting stand 3, and a shade 7 composed of a shade member 5 disposed around the lighting stand 3 and a shielding/diffusing member 6 disposed inside the shade member 5.

Figure 2:
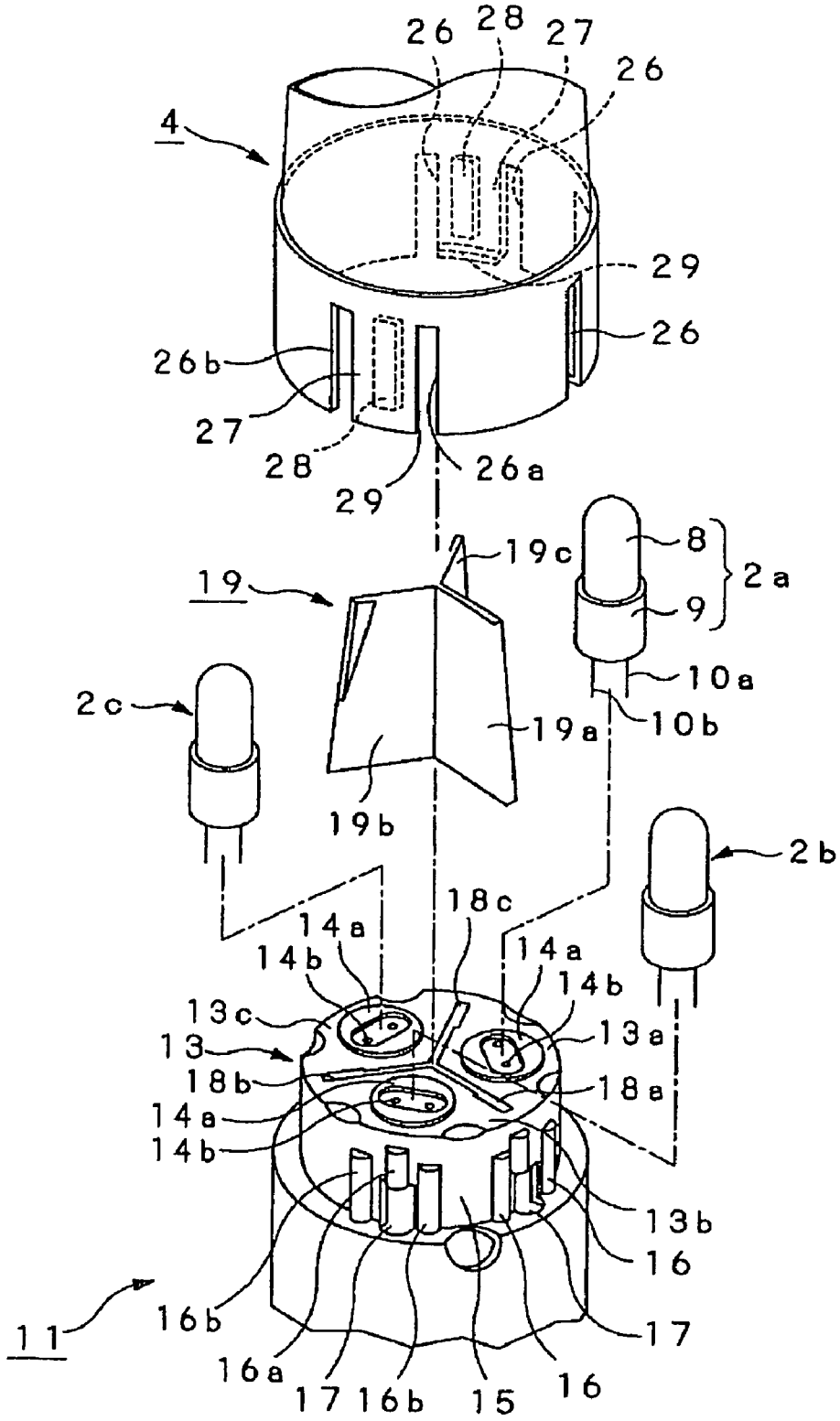
FIG. 2 is an exploded perspective view of the substantial part of the lighting stand.

Each of the light sources 2*a* to 2*c* is a small incandescent lamp that emits light red light approximate to, for example, a candle frame. As shown in FIG. 2, each of the light sources 2*a* to 2*c* includes a bulb 8 having a filament enclosed therein, an insulating tube 9 to cover a lower portion of the bulb 8, and a pair of pin terminals 10*a* and 10*b* projecting from the lower end of the bulb 8. Each of the light sources 2*a* to 2*c* is replaceably supported on the lighting stand 3 as will be described in detail later.

Note that each of the light sources 2*a* to 2*c* may be a lamp that emits light varying in color as necessary or a small light source such as a discharge tube, LED or the like. Although three light sources 2*a* to 2*c* are used herein, the present invention is not limited to this number but less than two or more than four light sources may be used. An increased number of light sources will be able to create more elaborate flaring of the illumination light.

The lighting stand 3 includes a torch portion 11 and base portion 12. The torch portion 11 is formed generally cylindrical by molding a synthetic resin. The cylinder includes a stepped upper-end portion of which the diameter is smaller than the rest, and a disk-shaped fixing flange portion 14 formed integrally about a lower-end portion thereof. Of the torch portion 11, the upper-end portion forms a light source support 13 on which the light sources 2*a* to 2*c* are removably supported. The torch portion 11 is installed at the fixing flange portion 14 thereof to the base portion 12.

As shown in FIG. 2, the torch portion 11 has also a fitting portion 15 provided on the outer surface of the light source support 13. The light scattering member 4 is removably fitted on the fitting portion 15. The torch portion 11 further has formed therein a cut 17 through which heat from the light sources 2*a* to 2*c* is liberated to outside. It should be noted that the shape of the torch portion 11 is not limited to the cylinder but may be a polygonal cylinder.

On the light source support 13 which is the upper portion of the torch portion 11, three separator fixing recesses 18*a* to 18*c* are formed radially from the center and equidistantly from each other. The light source support 13 is divided circumferentially by the separator fixing recesses 18*a* to 18*c* into three areas 13*a* to 13*c* in which the light sources 2*a* to 2*c* are installed respectively. In each of the areas 13*a* to 13*c* of the light source support 13, there are formed a circular seat 14*a* to hold the insulating tube 9 of each of the light sources 2*a* to 2*c* and a pair of terminal holes 14 in which the pin terminals 10*a* and 10*b* in pair are to be inserted. In the light source support 13, the depth to the terminal hole 14*b* is defined by the height of the seat 14*a*. In each terminal hole 14*b*, there is provided a cylindrical terminal (not shown) for electrical connection of the pin terminals 10*a* and 10*b*. Also, the light sources 2*a* to 2*c* can be varied in height by forming the seat 14*a* to a different height.

The fitting portion 15 on which the light scattering member 4 is fitted has a guide rib 16 and cut 17 formed on the outer surface thereof in a position on the forward extension of each of the separator fixing holes 18*a* to 18*c*. Also, the fitting portion 15 on which the light scattering member 4 is fitted has a first guide rib 16*a* and second cut 17 formed on the outer surface thereof in a position on the backward extension of each of the separator fixing recesses 18*a* to 18*c*. The first guide rib 16*a* is somewhat smaller in height. The fitting portion 15 has a second guide rib 16*b* and third guide rib 16*c* formed on the outer surface thereof on opposite sides, respectively, of the first guide rib 16*a* and second cut 17. The light scattering member 4 is removably fitted on the fitting portion 15 to cover the light sources 2*a* to 2*c*.

Each of the separator fixing recesses 18*a* to 18*c* is partially varied in width to have a plurality of concavo-convexities. Each of separators 19 defining the areas 13*a* to 13*c* is held at the concavo-convexities in each of the separator fixing recesses 18*a* to 18*c*. The separators 19 are formed from a sheet metal mirror-finished for a high reflectance and folded into three in the width direction. Thus the cross section of the separators 19 is generally Y-shaped. The separators 19 define generally triangular spaces 19*a* to 19*c* each by adjacent two of them. The spaces 19*a* to 19*c* thus defined by the separators 19 are taller than the light sources 2*a* to 2*c*. The sheet metal is bent so that the spaces 19*a* to 19*c* are gradually narrower toward the upper end thereof.

Being inserted at the lower end into each of the separator fixing recesses 18*a* to 18*c*, the separator 19 is fixed to the light source support 13. In each of the separator fixing recesses 18*a* to 18*c*, the separator 19 is pinched in the thickness direction at the concavo-convexities formed on the inner wall of each separator fixing recess. Thus, the separators 19 are held on the light source support 13. The separators 19 thus fixed to the light source support 13 isolate the three light sources 2 installed in the areas 13*a* to 13*c*, respectively, of the light source support 13 from each other.

Namely, isolating the spaces 19*a* to 19*c* in which the light sources 2*a* to 2*c* are provided, respectively, the separators 19 fixed to the light source support 13 as above permit to efficiently reflect light emitted from the light sources 2*a* to 2*c* outwardly and thus create illumination having a emphasized flaring.

Note that the separator fixing recesses 18*a* to 18*c* and separators 19 may not necessarily be provided in the present invention and they may not be shaped as above. Although it is necessary that the separators 19 should have a sufficient reflectance but each of them may be an upright wall formed integrally with the torch portion 11, for example.

As shown in FIG. 1, the torch portion 11 has extended in the internal space thereof a lead wire 20 connected to each of the light sources 2*a* to 2*c* via the cylindrical terminal of which one end is provided in the light source support 13. In the torch portion 11, a plurality of fixing cylinders is formed integrally on the bottom of the fixing flange portion 14 and fixed to the base portion 12 with set screws driven into each of the fixing cylinders from the side of the base portion 12. As shown in FIG. 1, the fixing flange portion 14 has provided on the top thereof a plurality of upright engagement projections 21*a* to 21*c* permitting to fixing a shade member of a smaller diameter directly to the fixing flange portion 14 as necessary. The first engagement projection 21*a* has the free end portion thereof bent outwardly to have a hook-like shape.

Note that the number of first engagement projections 21*a* is not limited to any one so long as they can positively catch a smaller-diameter shade member. Designed similarly to the light scattering member 4 which will be described in detail later, the small-diameter shade member scatters light emitted from the light sources 2*a* to 2*c*.

In the torch portion 11, the light sources 2*a* to 2*c* are fixed on the same circle on the light source support 13 as mentioned above. However, the torch portion 11 may not necessarily be constructed as above. In the torch portion 11, there may be formed, for example, a plurality of light source supports having the light sources 2*a* to 2*c* fixed to the outer surface thereof at different levels, respectively, like a Christmas tree in addition to, or in place of, the above-mentioned light source support 13.

The base portion 12 is a bottomed cylinder formed from a synthetic resin to be larger in diameter than the torch portion 11. The base portion 12 has a plurality of fixing holes (not shown) formed in the bottom thereof correspondingly to the fixing cylinders of the fixing flange portion 14. The torch portion 11 is supported upright on the base portion 12 by combining them so that the fixing flange portion 14 closes the upper opening of the base portion 12 with the fixing holes being positioned opposite to the fixing cylinders and screwing the fixing flange portion 14.

Note that in the lighting stand 3, for example, the fixing flange portion 14 of the torch portion 11 may be formed to be a large-diameter cylinder open at the bottom thereof and the open bottom of the fixing flange portion 14 be closed with the disk-shaped base portion 12. Also, the base portion 12 has only to hold the torch portion 11 stably upright, and may not necessarily be circular but may be polygonal, for example.

The base portion 12 has provided in the inner space thereof a control circuit unit 22 to which the other end of the lead wire 20 is connected, which is not illustrated in detail. The control circuit unit 22 includes a printed wiring board on which a memory and CPU (central processing unit) are mounted, and has formed thereon a light source drive circuit composed of a power circuit to supply a predetermined voltage to each of the system components, transistor, resistor, etc. Also, the base portion 12 has provided on the outer surface thereof a coaxial connector 23 having connected to one end thereof the jack of a power cord 24 connected to a commercial power source (power outlet) via an AC-DC converter (not shown). A DC power converted into a predetermined voltage is supplied to the internal power circuit of the control circuit unit 22, through the power cord 24. The base portion 12 has provided on the outer surface thereof a power switch 25 that can turn off the light sources 2*a* to 2*c* when it is not intended to use the illumination device 1.

Note that the illumination device 1 is designed to operate with a commercial power but it may be adapted to operate with a battery provided inside the base portion 12, for example. In this case, a rechargeable battery is suitably usable with the illumination device 1.

The memory in the control circuit unit 22 has stored therein control data used for controlling the on/off intervals of each of the light sources 2*a* to 2*c*, and amount of light emission from the light source, etc. individually. Each of the control data is obtained by measuring the changes of a candle frame by an illuminance meter, for example, and digitizing the results of measurement for controlling the light emission of each of the light sources 2*a* to 2*c*.

The CPU reads the control data for the light sources 2*a* to 2*c* from the memory and drives the respective light source drive circuits for the light sources 2*a* to 2*c* on the basis of these control data to control the light emission from each of the light sources 2*a* to 2*c*. A transistor, for example, provided in each of the light source drive circuits is driven with a pulse-width modulation signal for adjusting the pulse width of the light emission pattern, whereby the light sources are repeatedly turned on and off at appropriate intervals and amounts of light emission from the light sources are appropriately adjusted.

The light scattering member 4 is installed on the fitting portion 15 provided at the top of the torch portion 11. The light scattering member 4 is formed from a transparent or semitransparent resin, for example, to have a generally truncated-conical cap gradually smaller in diameter toward the upper end as shown in FIG. 1. The light scattering member 4 is formed coarse at the outer surface thereof, for example, to scatter the illumination light emitted from the light sources 2*a* to 2*c* covered with the light scattering member 4. The light scattering member 4 is formed elongated, for example, generally truncated-conical, to project illumination light like a candle frame onto the surface of the shade member 5.

Note that the light scattering member 4 has only to be elongated but is not limited in shape to the above-mentioned truncated cone. The shape of the light scattering member 4 may be a shell approximate to the shape of a candle frame, for example. The light scattering member 4 may be formed by molding a milk-white synthetic resin or an appropriated colored synthetic resin, for example.

Of the light scattering member 4, the outside diameter of the bottom is nearly equal to the inside diameter of the fitting portion 15 on which the light scattering member 4 is fitted. The light scattering member 4 has formed therein a plurality of pairs of vertical engagement recesses 26*a* and 26*b* corresponding to the second and third guide ribs 16*b* and 16*c* formed at the fitting portion 15 on which the light scattering member 4 is fitted. In the light scattering member 4, there remains a vertical tongue piece 27 between the engagement recesses 26*a* and 26*b* in each piece. A vertical concavity 28 is formed in the inner surface of each tongue piece 27 correspondingly to each first guide rib 16*a* at the fitting portion 15 on which the light scattering member 4 is fitted, and an engagement projection 29 is formed on the lower end of the tongue piece 27 to project inwardly. The light scattering member 4 is fitted onto the fitting portion 15 from above with the second and third guide ribs 16*b* and 16*c* being kept opposite to the engagement recesses 26*a* and 26*b*, respectively.

Then, as each tongue piece 27 is elastically displaced, each engagement projection 29 rides on the outer surface of the first guide rib 16*a* and goes over the guide rib 16*a* to engage on the lower end of the latter. The light scattering member 4 covers the light sources 2 supported on the light source support 13, is limited by the torch portion 11 against rotation and disengagement. The light scattering member 4 is thus assembled to the torch portion 11. Only when the light scattering member 4 thus assembled is forcibly pulled, it can be detached from the torch portion 11.

When it is desirable that the light scattering member 4 should have another color tone, for example, it can be replaced with a light scattering member 4 having the desired color tone. In the lighting stand 3, when each light source 2 is turned on, the light scattering member 4 allows illumination light emitted from the light source 2 to pass by as soft indirect light. Since the light scattering member 4 is formed elongated like a candle frame, the illumination light from the light sources 2*a* to 2*c* can be scattered like a candle frame between the light scattering member 4 and shade member 5.

The lighting stand 3 can be assembled very easily by fixing the light sources 2*a* to 2*c* and separators 19 to the light source support 13 and also fitting the light scattering member 4 onto the light source support 13 in the direction in which the light sources 2*a* to 2*c* have been fixed. Therefore, when changing the color tone of the illumination device 1, for example, the light sources 2*a* to 2*c* and light scattering member 4 can easily be replaced.

The lighting stand 3 is covered with the shade 7 composed of the shade member and shielding/diffusing member 6 for an appropriate distance to be assured between the lighting stand 3 and shade 7 as shown in FIG. 1 when the illumination device 1 is placed on a table or the like. The shade member 5 is formed by molding a transparent synthetic resin highly excellent in light transmittance, such as acrylic, polycarbonate or the like to have a cylindrical shape having a larger diameter than the outside diameter of the base 12 of the lighting stand 3 and longer than the lighting stand 3.

The base portion 12 and shade member 5 are in a relation that will be explained below. Namely, when the base portion 12 is about 67 mm in diameter, for example, the inner diameter of the shade member 5 is to be about 70 to 100 mm. With the inside diameter of the shade member 5 being generally equal to the outside diameter of the base portion 12, the shade member 5 can be fitted on the base portion 12 and secured to the latter stably.

Also, the shade member 5 and light sources 2*a* to 2*c* are in a relation that will be explained below. The light source support 13 having the light sources 2*a* to 2*c* fixed thereon is about 19 mm in diameter. The illumination light emitted from the light sources 2*a* to 2*c* fixed to the light source support 13 of about 19 mm in diameter will appropriately be scattered by the light scattering member 4 to the shade member 5 of about 70 to 100 mm in inside diameter before reaching the shade 7. In other words, the ratio between the inside diameter of the shade member 5 and that of the light source support 13 is 19:70 to 100.

The illumination light projected on the shade member 5 is elongated as having been described above. On this account, the light sources 2*a* to 2*c* are located in a lower position lower than a half of the shade 7, for example, to prevent the upper end of the projected illumination light like a candle frame from ending at the upper end of the shade member 5.

Also, the shade member 5 has an outer surface formed axially straight. In this embodiment, it is formed cylindrical, for example. The shade member 5 is formed to an appropriate thickness so that it can stably be placed on a table or the like. It should be noted that the material of the shade member 5 is not limited to any transparent resin but it may be glass, for example.

Since the shade member 5 has the outer surface formed axially straight like a cylinder, the illumination light emitted from the light sources 2*a* to 2*c* of the lighting stand 3 and scattered by the light scattering member 4 is radiated circumferentially of the shade member 5 while being refracted axially to spread. Thus, an elongated image of the illumination light will appear like a candle frame on the surface of the shade member 5.

The shade member 5 has formed at the lower end portion thereof a cut 30 through which the power cord 24 can be led into the shade member 5 and connected to the coaxial connector 23 with the shade member 5 being installed in position to cover the lighting stand 3.

Note that the shade member 5 may not necessarily be shaped cylindrical as above but it may be formed as a polygonal cylinder. Also, for choice of a desired color tone of the shade 7, the shade member 5 may appropriately be colored unless the coloring will considerably reduce the light transmittance. For this purpose, shade members 5 of various colors may be prepared and a shade member 5 in a desired color may be selected for use with the lighting stand 3 of the illumination device 1. Further, the shade member 5 may have a top integrally formed therewith. The top may be formed flat or semicircular, for example.

Figure 3:
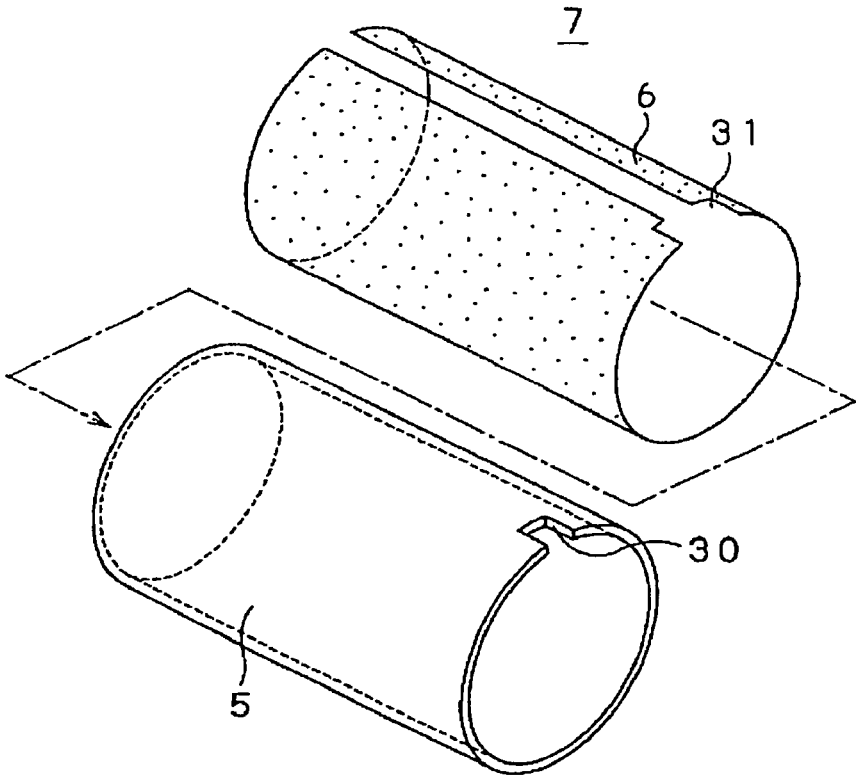
FIG. 3 is also an exploded perspective view of the shade member and shielding/diffusing member.

The shielding/diffusing member 6 fixed to the inner surface of the shade member 5 is made of a semitransparent diffusing sheet including a transparent film as a substrate and a light diffusing layer formed, by coating to the substrate, from a resin having fine transparent beads mixed therein. As shown in FIG. 3, the shielding/diffusing member 6 is formed to have a width nearly equal to the axial length of the shade member 5 and a length equal to or a little longer than the length of the inner surface of the shade member 5. When rounded like a cylinder and attached over the inner surface of the shade member 5, the shielding/diffusing member 6 will be resilient to open out. The shielding/diffusing member 6 has also a cut 31 formed therein at the lower end correspondingly to the cut 30 in the shade member 5. The power cord 24 is led into the lighting stand 3 through the cuts 30 and 31 with the shade 7 being fitted to the base portion 12.

Note that the shielding/diffusing member 6 may not necessarily be formed from the above-mentioned diffusing sheet but it may be formed from any material that has a shielding function and is elastic to some extent. For example, a Japanese paper may also be used suitably as a material of the shielding/diffusing member 6.

As shown in FIG. 3, the shade 7 includes the above-mentioned shade member 5 and shielding/diffusing member 6. The shielding/diffusing member 6 is rounded to have a cylindrical shape so that its longitudinal end portions overlap each other along the length thereof and inserted into the shade member 5. Since the shielding/diffusing member 6 is resilient to open out, it will be in close contact with the inner surface so that the light can be prevented from uselessly being diffused between the shade member 5 and shielding/diffusing member 6. As mentioned above, the shade member 5 of the shade 7 is formed from the transparent or semitransparent synthetic resin but the light diffusing layer of the shielding/diffusing member 6 attached over the inner surface of the shade member 5 prevents the lighting stand 3 disposed inside the shielding/diffusing member 6 from being visible directly from outside. When the lighting stand 3 is turned on and the light sources 2*a* to 2*c* are thus turned on, the shade 7 will diffuse the illumination light from the light sources 2*a* to 2*c* for radiation from the outer surface of the shade member 5 to outside.

Having a simple structure including the shade member 5 and the cylindrically rounded shielding/diffusing member 6 attached on the inner surface of the shade member 5, the shade 7 can be produced very inexpensively. In the shade 7, the shielding/diffusing member 6 can be attached removably to inside the shade member 5. Using an appropriately-colored shielding/diffusing member 6 as above, the illumination device 1 can provide illumination of another atmosphere. With the shade 7 being held at an appropriate distance from the lighting stand 3, the illumination light radiated through the light scattering member 4 of the lighting stand 3 will incident upon the entire circumference of the shade 7.

Figure 4:
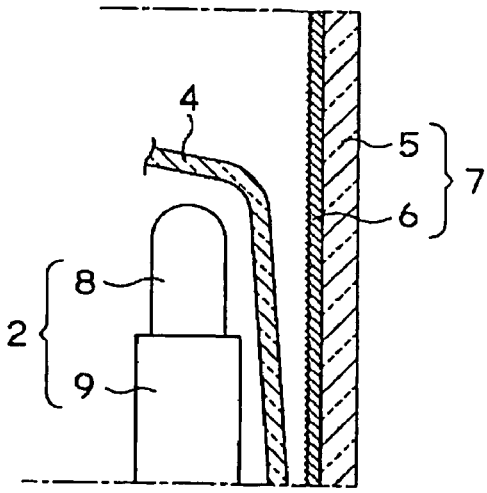
FIG. 4 is an axial sectional view of the substantial part of the lighting stand.

The illumination device 1 constructed as above is placed on a table with the lighting stand 3 being covered with the shade 7 as shown in FIGS. 1 and 4. In the illumination device 1, the power cord 24 is led through the cuts 30 and 31 and connected to the coaxial connector 23. With the power switch 25 being turned on, the light sources 2*a* to 2*c* are turned on. In the illumination device 1, illumination light emitted from the light sources 2*a* to 2*c* supported on the light source support 13 supported on the light source support 13 formed at the top of the torch portion 11 and thus positioned at a predetermined height from the table surface is radiated through the light scattering member 4 formed like a candle frame and radiated inside the shade 7.

In the illumination device 1, the illumination light scattered by the light scattering member 4 is incident upon the shade 7 from its entire surface as shown in FIG. 4. The illumination light is diffused by the shielding/diffusing member 6 of the illumination device 1 and radiated from the outer surface of the shade member 5 to illuminate the surrounding. At this time, the shade member 5 radiates the illumination light circumferentially thereof and refracts it axially to spread axially. Therefore, an elongated image of the illumination light like a candle frame will appear on the surface of the shade member 5.

Of the illumination device 1, the shade 7 will be most bright at a predetermined height from the table surface and the light scattering member 4 look vague through the shielding/diffusing member 6, to thereby give an impression that a candle is lighting inside the shade 7. Since the illumination device 1 uses the light scattering member 4 and shielding/diffusing member 6, each formed from a transparent material as above, it is possible to prevent the lighting stand 3, that is, the light sources 2*a* to 2*c*, from being visible directly from outside the shade 7. It should be noted that the shade 7 can be given a desired color by selecting a light scattering member 4, shade member 5 and shielding/diffusing member 6 of a desired color from those prepared to have various colors.

Figure 5A:
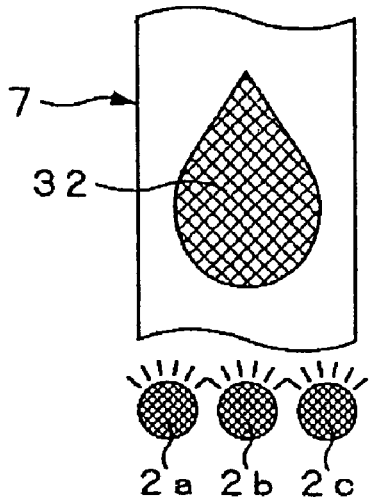
FIGS. 5A to 5C show flaring of the illumination light projected on the shade member.

In the illumination device 1, the light sources 2*a* to 2*c* are controlled for light emission by the control circuit unit 22. In the illumination device 1, when the light sources 2*a* to 2*c* are controlled for a predetermined amount of light emission by the control circuit unit 22, the illumination light is incident upon a wide range of the shade 7. Then, an elongated image 32 of a candle frame will appear having a maximum height and width on the surface of the shade 7 as shown in FIG. 5A.

Figure 5B:
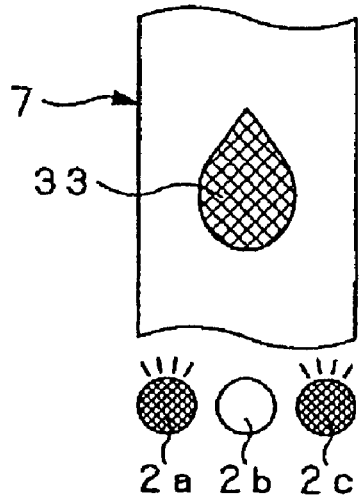

In the illumination device 1, when a predetermined time elapses, the light emission from the light sources 2*a* to 2*c* is changed under the control of the control circuit unit 22. For example, the light source 2*b* is turned off with the light sources 2*a* and 2*c* being kept on. Then, the amount of light emission will be smaller than that when all the light sources 2*a* to 2*c* are lit so that the image appearing on the surface of the shade 7 will totally be smaller. That is, as will be seen from FIG. 5B, an image 33 appearing on the surface of the shade 7 will be shorter in height than the image 32 shown in FIG. 5A and be narrower and totally darker at the image portion corresponding to the light sources 2*a* and 2*c* that are on.

Note that the image portion corresponding to the light source 2*b* that is off is still darker than the image portion corresponding to the light sources 2*a* and 2*c* because it is away from the separators 19.

In the illumination device 1, when a more predetermined time elapses, only the light source 2*c*, for example, is turned on while the light sources 2*a* and 2*b* are turned off. Then, the total amount of light emission will be smaller than that when all the light sources 2*a* to 2*c* or any two of them are turned on and an image 34 appearing on the surface of the shade 7 be further smaller. That is, the image 34 on the surface of the shade 7 will appear in a higher position than that shown in FIG. 5B and be narrowest and darkest, as seen from FIG. 5C.

Note that the image portion corresponding to the light sources 2*a* and 2*b* that are off is still darker than the image portion corresponding to the light source 2*c* because it is away from the separators 19.

Figure 5C:
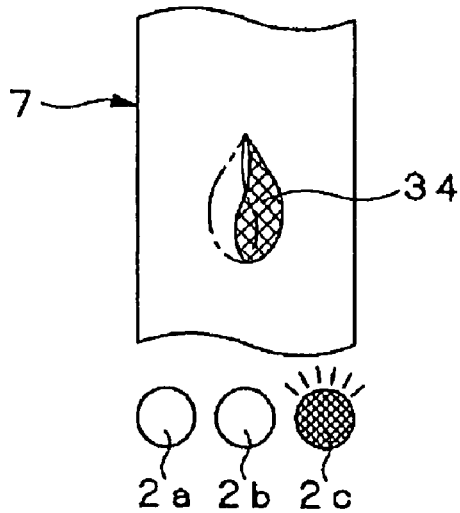

Also, when only the light source 2*a* is turned on, an image will result as indicated with a dashed line in FIG. 5C. That is, the image 34 appears in positions that depends upon which of the light sources is or are turned on.

As having been described in the foregoing, in the illumination device 1, the on/off operation of the light sources 2*a* to 2*c* can be controlled to change the amount of light emission from the three light sources 2*a* to 2*c* and change the size and brightness of the image appearing on the shade 7, to thereby provide a flaring illumination light like a candle frame.

It has been explained in the foregoing that the light sources 2*a* to 2*c* emit a constant amount of light, but it should be reminded that each of the light sources 2*a* to 2*c* may be adapted to emit a variable amount of light to provide a further elaborate image of a candle frame. Also it should be noted that the pattern of controlling the light sources 2*a* to 2*c* is not limited to those shown in FIGS. 5A to 5C.

In the illumination device 1, on/off operation and intervals, amount of light emission and on/off duration of each of the light sources 2*a* to 2*c* can be controlled by the control circuit unit 22 to change the image appearing on the surface of the shade 7 variously as the time elapses. Thus, the illumination light emitted from the light sources 2*a* to 2*c* is scattered by the light scattering member 4 and shielding/diffusing member 6 to provide indirect soft illumination and a flaring illumination image appearing as if a lighting candle were placed inside the shade 7. Namely, the illumination device 1 can create a unique healing and comforting atmosphere.

Figure 6A:
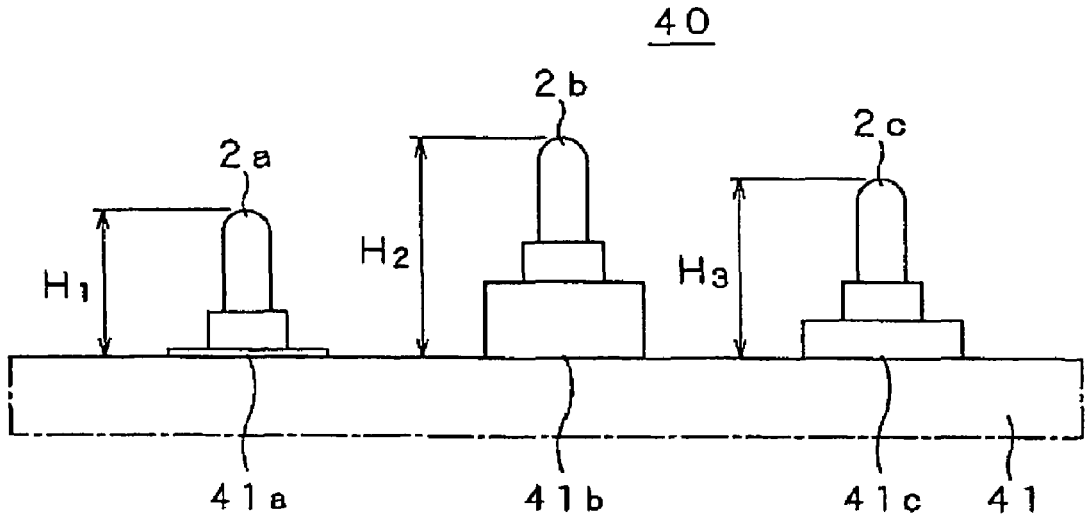
FIG. 6A is a development of the substantial part of the light source support and FIG. 6B shows flaring of the illumination light projected on the shade member.

In the aforementioned illumination device 1, the total amount of light emission from the light sources 2*a* to 2*c* is changed based on the on/off pattern of the light sources 2*a* to 2*c* to provide a flaring illumination image on the surface of the shade 7. In an illumination device 40 shown in FIG. 6A, however, there may be included in place of the light source support 13 a light source support 41 that supports the light sources 2*a* to 2*c* at different levels as shown. The light source support 41 is to more emphasize the flaring of the illumination light. It should be noted that the other components of the illumination device 40 are similar to those of the illumination device 1 and so will not be explained in detail herein. That is, in the illumination device 40, the light source 2*a* is supported on a first support 41*a* to a height H1, light source 2*b* is supported on a second support 41*b* to a height H2, and light source 2*c* is supported on a third support 41*c* to a height H3. The first to third supports 41*a* to 41*c* for the light sources 2*a* to 2*c* are different in height from each other so that the light sources 2*a* to 2*c* are in a height relation of H1<H3<H2 with one another.

Figure 6B:
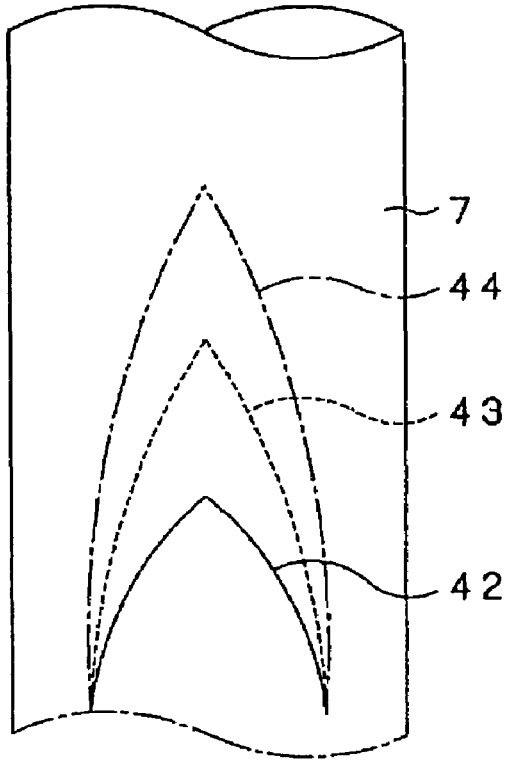

Therefore, when only the light source 2*a* at the highest level is turned on, a shortest image 42 will appear on the surface of the shade 7 as shown in FIG. 6B. Also, when the light source 2*a* and the light source 2*b* at the middle level are turned on, a middle-tall image 43 will appear on the surface of the shade 7. When all the three light sources 2*a* to 2*c* are turned on, a tallest image 44 will appear on the surface of the shade 7. By selecting one of the above-mentioned three states of light emission in the illumination device 40, the height of the image on the surface of the shade 7 can be changed to approximate the image defined by the illumination light to a flaring candle flame.

In the illumination device 40, a variety of illumination-light image flaring is presented with the light sources 2*a* to 2*c* being supported at the different levels, respectively, on the light source support 41. However, the present invention is not limited to this construction of the illumination device 40. For example, with light sources 2*a* to 2*c* different in size from each other being installed on the light source support 13 in the illumination device 1 having previously been described there can be provided a variety of illumination-light image flaring similar to the above.

Figure 7:
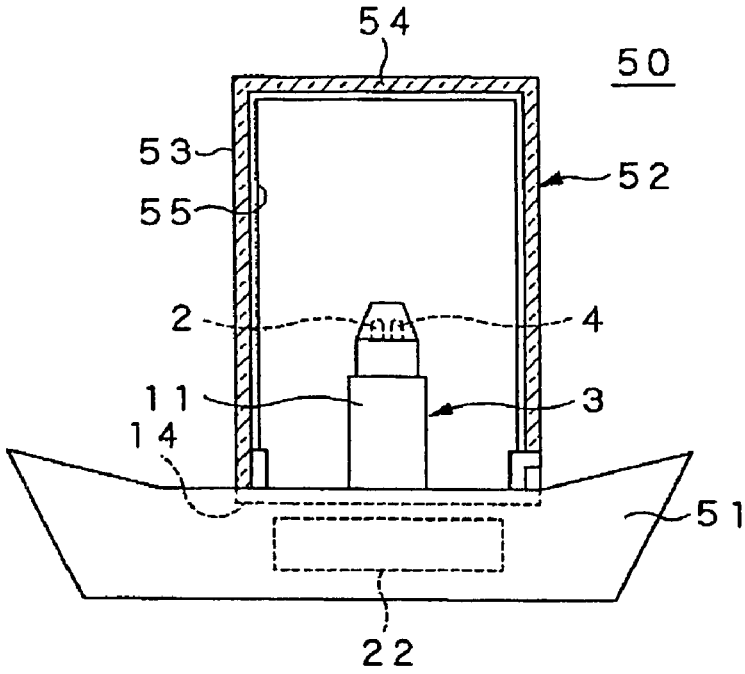
FIG. 7 is a partially fragmentary elevation of a boat-shaped illumination device as a first variant of the present invention.

FIG. 7 shows an illumination device as a first variation of the present invention. The illumination device is generally indicated with a reference numeral 50. This illumination device 50 includes a boat-shaped base portion 51 to which a shade 52 is integrally assembled. The illumination device 50 is suitably usable as a lantern that is to be placed by the side of a Buddhist altar in a Buddhist ceremony in Japan, for example. The other components of the illumination device 50 are nearly the same as those in the aforementioned illumination device 1, and so they will be indicated with the same reference numerals as those used to indicate the respective components of the illumination device 1 and will not be described any longer.

The illumination device 50 has the control circuit unit 22 included in the base portion 51. The top of the base portion 51, which is the deck of the boat, is formed from a fixing flange portion 14 of a torch portion 11. In the illumination device 50, a shade member 53 formed integrally with a cap 54 has formed appropriately in the lower end portion thereon a plurality of engagement recesses which will not be explained in detail herein. With engagement projections 21 being engaged in the respective engagement recesses, the shade 53 is assembled integrally to the base portion 51. It should be noted that the illumination device 50 can be formed suitably to an intended use by forming the base portion 51 in an appropriate shape of a thing, animal or the like.

In the illumination device 50, illumination light emitted from light sources 2*a* to 2*c* passes by a shielding/diffusing member 55 attached inside a light scattering member 4 and shade member 53 to illuminate the surrounding while flaring like a candle frame. Since the illumination device 50 is extremely safe because it illuminates around the Buddhist altar fantastically and it does not make any direct flame.

Figure 8:
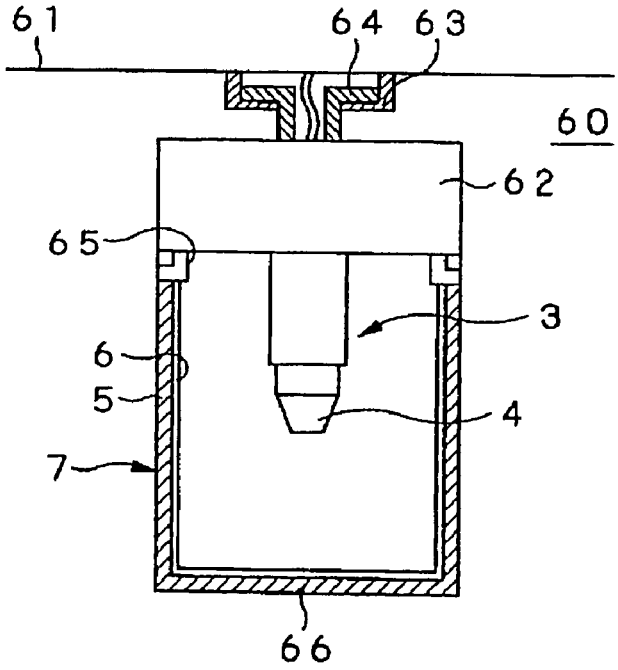
FIG. 8 is an axial sectional view of a downlight type illumination device as a second variant of the present invention.

FIG. 8 shows an illumination device as a second variant of the present invention. The illumination device generally indicated with a reference numeral 60 is to be installed to a ceiling 61. It includes a base portion 62 and has a fixing portion 64 formed integrally on the bottom of a base portion 62 and which can be installed to a jig 63 installed on the ceiling 61 and to which the illumination device 60 is to be fixed. The illumination device 60 is electrically connected to an indoor wiring via the fixing portion 64. The illumination device 60 has assembled integrally thereto with an engagement portion 65 formed on the base portion 62 a shade 7 including a shade member 5 and shielding/diffusing member 6. In the illumination device 60, illumination light emitted from light sources 2*a* to 2*c* and converted into soft indirect light by a light scattering member 4 and shielding/diffusing member 6 as above provides flaring light emission like a candle frame. In the illumination device 60, illumination light is also radiated from a cap portion 66 of the shade member 5.

Each of the aforementioned embodiments and variants of the present invention includes one lighting stand 3 and shade 7 in combination, but a plurality of these combinations may be used in one illumination device. In such an illumination device, the light sources in the lighting stands may be controlled together and a control circuit unit may not be provided for each lighting stand. In this case, a control box including a control circuit unit, for example, is provided for the illumination device and each lighting stand 3 is connected to the control box.

The invention claimed is:

1. An illumination device comprising:

a plurality of light sources which are changed in light emission individually under the control of a control circuit;

a lighting stand including a torch portion having installed integrally thereto a light source support to removably support each of the light sources at a predetermined height in proximity circumferentially to one another, and a base portion supporting the torch portion in upright position;

a cap-shaped light scattering member removably fitted to the light source support to scatter illumination light emitted from each light source;

a transparent or semitransparent shade member shaped in the form of a cylinder having a longer axis and larger diameter than the lighting stand and installed to surround the lighting stand; and a shielding/diffusing member removably installed inside the shade member to shield the lighting stand while further diffusing the illumination light emitted from each light source so that the illumination light will go out of the outer surface of the shade member, said light source support defining separate areas for said light sources by a separator formed by bending a thin metal sheet inserted into fitting recesses formed between said light sources on an end face of said torch portion; said thin metal sheet being bent so as to be gradually narrower in width upwards from said base portion along the axial direction to form said separator;

the light emission from the light sources being controlled to change the brightness of the illumination light on the outer surface of the shade member, to thereby create flaring illumination light like a candle frame.

2. The device according to claim 1, wherein the shade member has the outer surface thereof formed linearly in the axial direction.

3. The device according to claim 2, wherein the shade member includes a cap portion.

4. The device according to claim 1, wherein the ratio in inside diameter between the light source support and shade member is 19:70 to 100.

5. The device according to claim 4, wherein the light sources are disposed at a level higher than about a half of the height of the shade member.

6. The device according to claim 2, wherein the shielding/diffusing member has an elasticity for radial spread-out from a rolled-up state and can be removably attached over the inner surface of the shade member.

7. The device according to claim 6, wherein the shielding/diffusing member is a semitransparent sheet having a light diffusion layer formed thereon by coating a transparent resin film as a substrate with a resin.

* * * * *